US007549885B1

(12) United States Patent
Oh et al.

(10) Patent No.: US 7,549,885 B1
(45) Date of Patent: Jun. 23, 2009

(54) COMPOSITE GENERAL PURPOSE RECTANGULAR CONNECTOR

(75) Inventors: Lawrence Se-Jun Oh, Hummelstown, PA (US); James Patrick Mosier, Palmyra, PA (US); William Wade Haymaker, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/203,672

(22) Filed: Sep. 3, 2008

(51) Int. Cl.
*H01R 13/627* (2006.01)

(52) U.S. Cl. ..... 439/316; 439/247

(58) Field of Classification Search ..... 439/316, 439/247, 314, 362, 364, 248
See application file for complete search history.

(56) References Cited

U.S. PATENT DOCUMENTS

| | | | | |
|---|---|---|---|---|
| 5,324,209 | A * | 6/1994 | Falossi et al. | 439/362 |
| 5,348,494 | A * | 9/1994 | Falossi et al. | 439/362 |
| 5,383,795 | A * | 1/1995 | Falossi et al. | 439/362 |
| 7,074,065 | B1 * | 7/2006 | Martinez et al. | 439/247 |
| 7,192,307 | B1 | 3/2007 | Tran et al. | |

* cited by examiner

*Primary Examiner*—Gary F. Paumen

(57) ABSTRACT

An electrical connector assembly is disclosed that includes a receptacle connector and plug connector. The receptacle connector includes a receptacle housing having a top surface and a bottom surface, a support plate, spacers configured to retain the support plate adjacent to the top surface, and a post retained against the support plate by a spring and a fastener configured to releasable assemble the post and the support plate. The receptacle connector is less complex, lighter, and less expensive than receptacle connectors entirely made of a unitary composite, metal, or metallized composite.

23 Claims, 11 Drawing Sheets

COMPOSITE GENERAL PURPOSE RECTANGULAR CONNECTOR

FIELD OF THE INVENTION

The present invention relates to electrical connector assemblies. More specifically, the present invention relates to an electrical connector assembly having a receptacle connector with a threaded insert, support plate and spacer.

BACKGROUND OF THE INVENTION

Electrical connector assemblies typically include a plug connector and a receptacle connector configured to mate with the plug connector. The plug connector generally includes a plug housing containing contacts, and the receptacle connector generally a receptacle housing containing contacts configured to mate with the corresponding plug contacts. When the plug connector and receptacle connector are mated, the corresponding contacts mate to form an electrical connection.

In many applications, the receptacle connector utilizes machined components. The machined components can include mounting ears and spacers, which can be complex, heavy, and expensive to manufacture into the connector.

Therefore, there is an unmet need to provide an electrical connector assembly having a receptacle connector that is less complex, lighter, less expensive, and less susceptible to receptacle housing breakage than prior connector.

SUMMARY OF THE INVENTION

In one embodiment, an electrical connector assembly is disclosed that includes a receptacle connector and plug connector. The receptacle connector includes a receptacle housing having a top surface and a bottom surface, a support plate, spacers configured to retain the support plate adjacent to the top surface, and a post retained against the support plate by a spring and a fastener. The spring and fastener are configured to releasably assemble the post and the support plate to the receptacle housing. The receptacle connector is configured to mate with the plug connector by releasably engaging the post of the receptacle connector to the plug connector.

In another embodiment, a receptacle connector is disclosed that includes a receptacle housing having a top surface and a bottom surface, a support plate, spacers configured to retain the support plate adjacent to the top surface, and a post retained against the support plate by a spring and a fastener configured to releasably assemble the post and the support plate.

Further aspects of the method and system are disclosed herein. The features as discussed above, as well as other features and advantages of the present invention will be appreciated and understood by those skilled in the art from the following detailed description and drawings.

BRIEF DESCRIPTION OF THE DRAWINGS

Wherever possible, the same reference numbers will be used throughout the drawings to refer to the same or like parts.

DETAILED DESCRIPTION OF THE INVENTION

The present invention now will be described more fully hereinafter with reference to the accompanying drawings, in which a preferred embodiment of the invention is shown. This invention may, however, be embodied in many different forms and should not be construed as limited to the embodiments set forth herein; rather, these embodiments are provided so that this disclosure will be thorough and complete and will fully convey the scope of the invention to those skilled in the art.

Figure 1:
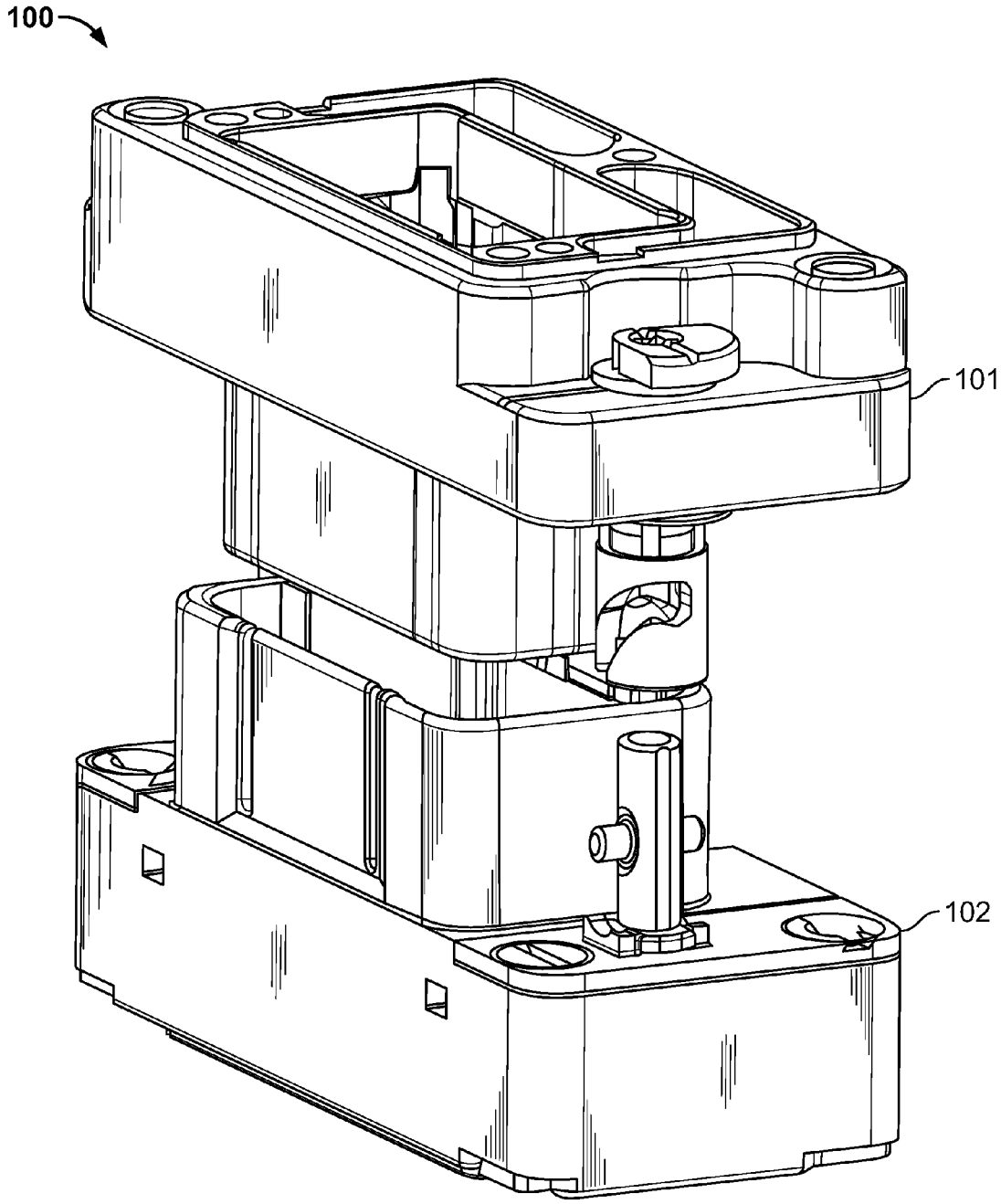
FIG. 1 illustrates a perspective view of an exemplary electrical connector assembly according to the disclosure.

FIG. 1 shows an exemplary embodiment of an electrical connector assembly 100 according to the disclosure. The electrical connector assembly 100 includes a plug connector 101 and a receptacle connector 102. The plug connector 101 is configured to mate with the receptacle connector 102. The plug connector 101 and receptacle connector 102 include corresponding mating terminals (not shown) disposed therewithin, which mate to form an electrical connection upon mating of the plug connector 101 and receptacle connector 102 as would be appreciated by one of ordinary skill in the art.

FIGS. 2-5 show an exemplary embodiment of a receptacle connector 102 according to the disclosure. The receptacle connector 102 includes a receptacle housing 104, a support plate 118, a post 120, spacers 122, a fastener 124, and a spring 126. The receptacle connector 102 further includes a plurality of electrical terminals (not shown) disposed therewithin, which have not been shown to simplify the inventive elements of the disclosure. The receptacle connector 102 may be formed of metals, metal alloys, plastics, composites, polymers and any combination thereof. For example, the receptacle connector may be formed of a light weight metal alloy, for example a magnesium-aluminum alloy. The light weight metal alloy may be machined or molded to form the various components. In another example, the receptacle connector 102 may be formed of engineered composites including reinforcing material. For example, the reinforcing material may include carbon, glass, carbon nanotubes, and micro-spheres.

The receptacle housing 104 includes a base portion 106 and a receiver shroud portion 108. The base portion 106 includes a top surface 112, end surfaces 114 and a bottom surface 116. The top surface 112 includes a support plate recess 133 configured to receive support plate 118. The bottom surface 116 includes spacer recesses 117 configured to receive spacers 122.

The receiver shroud portion 108 is configured to receive a portion of a corresponding plug connector (not shown). The receiver portion 108 includes grounding tabs 110 for releasably engaging plug connector 101 (FIG. 1). The grounding tabs 110 include contact portions 111. In another embodiment, the receiver portion 108 may not include grounding tabs 110. In this exemplary embodiment, the receiver portion 108 is offset in relationship to the base portion 106. In another embodiment, the receiver portion 108 may be symmetrically positioned in relationship to the base portion 106.

The support plate 118 includes countersunk through-holes 128, a slot 130, and positioning tabs 132. The support plate 118 is received in a recess 133 in the top surface 112 of the receptacle housing 104. The recess 133 includes insert holes 134 and a post hole 136 configured to align with the tapered through-holes 128 and slot 130, respectively, when assembled. The support plate 118 is retained in the recess 133 against the receptacle housing by the spacers 122 as will be discussed in detail below.

Figure 3:
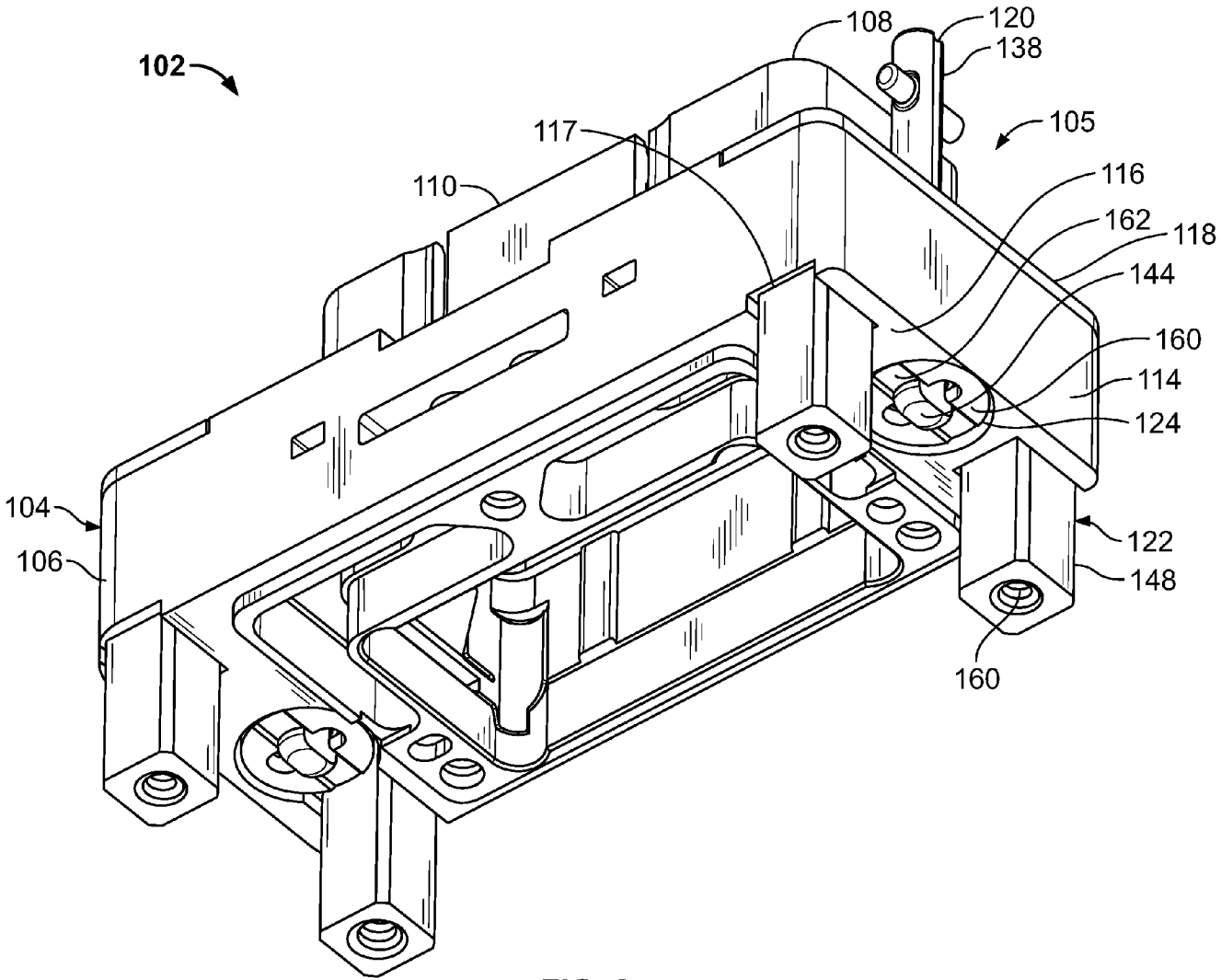
FIG. 3 illustrates a bottom perspective view of the receptacle connector of FIG. 2.
Figure 4:
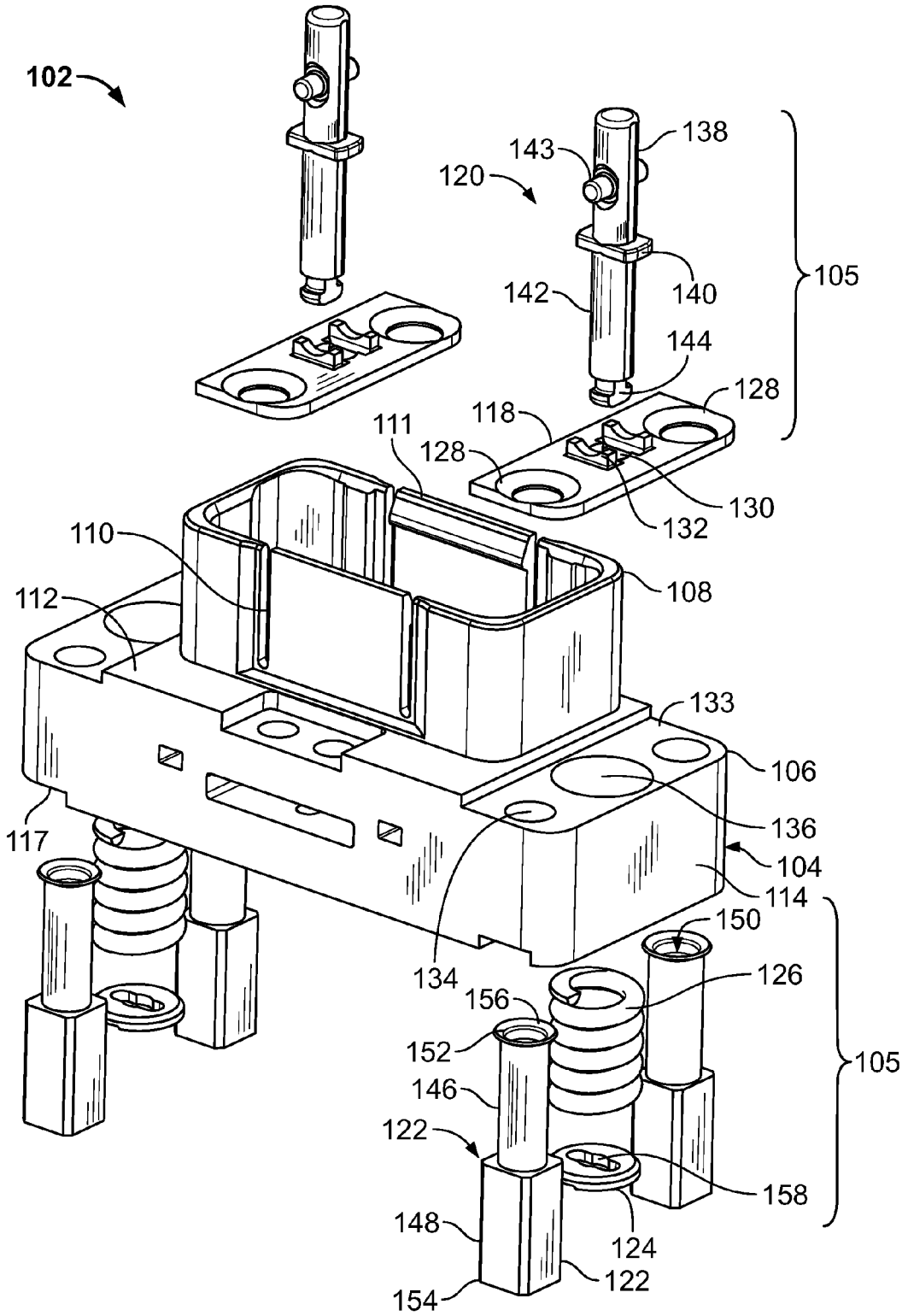
FIG. 4 illustrates an exploded perspective view of the receptacle connector of FIG. 2.

The post 120 includes an upper portion 138, a support plate 140, and a lower portion 142. The upper portion 138 includes pins 143. The lower portion 142 includes fastener feature 144. The support plate 140 is configured to be positioned over and in contact with slot 130 between tabs 132 of support plate 118, so as to fixedly position the locking post with respect to the support plate 118 and prevent the locking post 120 from rotating within the post hole 136 when the locking post 120 is releasably assembled with the support plate 118 by spring 126 and fastener 124 as shown in FIG. 3. The posts 120 are configured to be releasably engaged by the plug connector 101 (FIG. 1) so as to releasably mate the plug connector 101 and the receptacle connector 102.

Figure 2:
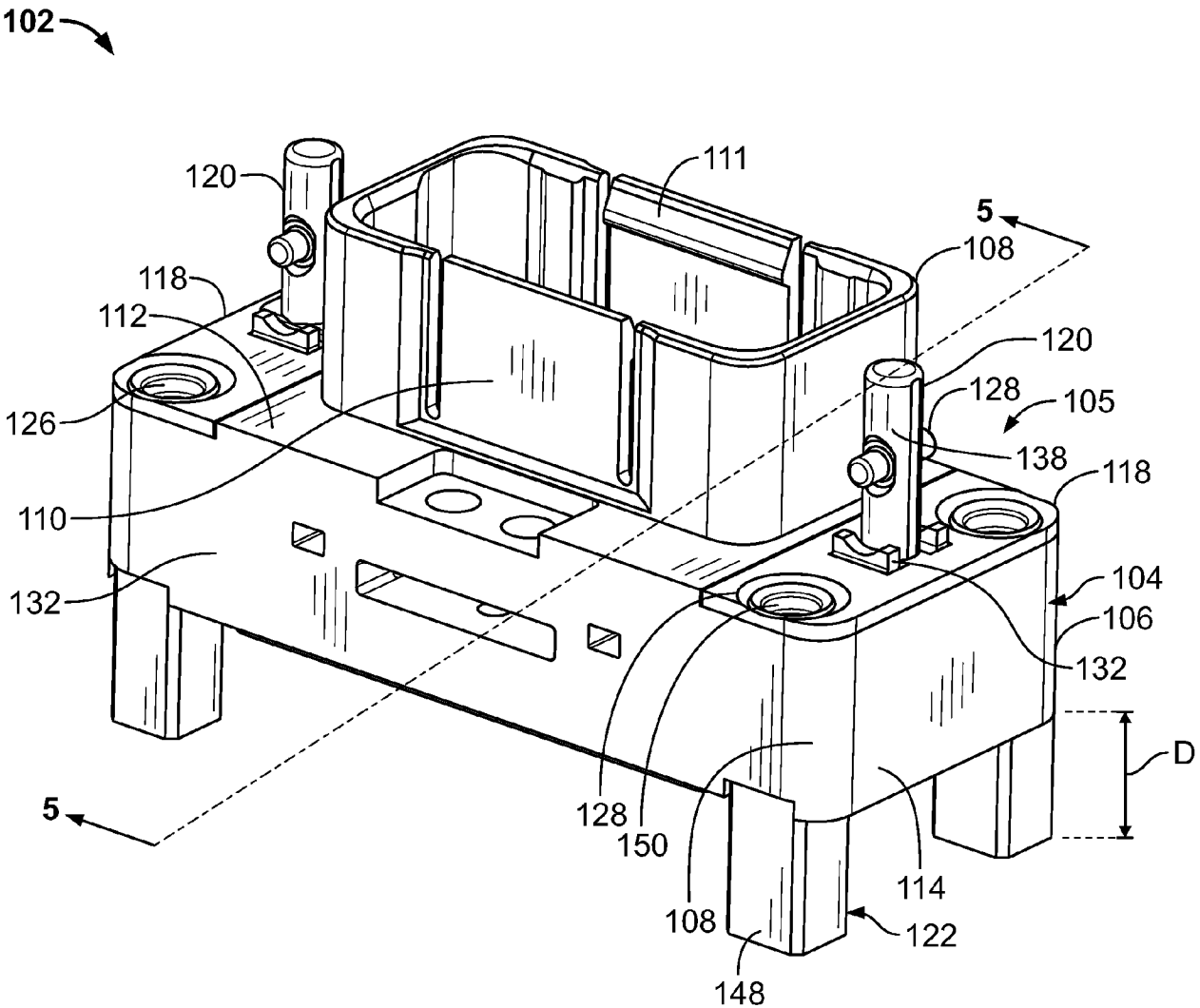
FIG. 2 illustrates a top perspective view of an exemplary receptacle connector according to the disclosure.

The spacers 122 include an insertion portion 146 and a spacer portion 148. In this exemplary embodiment, the spacers 122 are a single unit body including both the insertion portion 146 and the spacer portion 148. The spacer portion 148 extends away from the bottom surface 162 a predetermined distance D as shown in FIG. 2. In this exemplary embodiment, the spacers 122 are a unitary body. The spacers 122 may be formed by molding or other similar forming method. In another embodiment, the spacers 122 may be formed from an insertion portion 146 and a spacer portion 148 that are joined by know methods such as, but not limited to, thermal welding and adhesive bonding.

Figure 5:
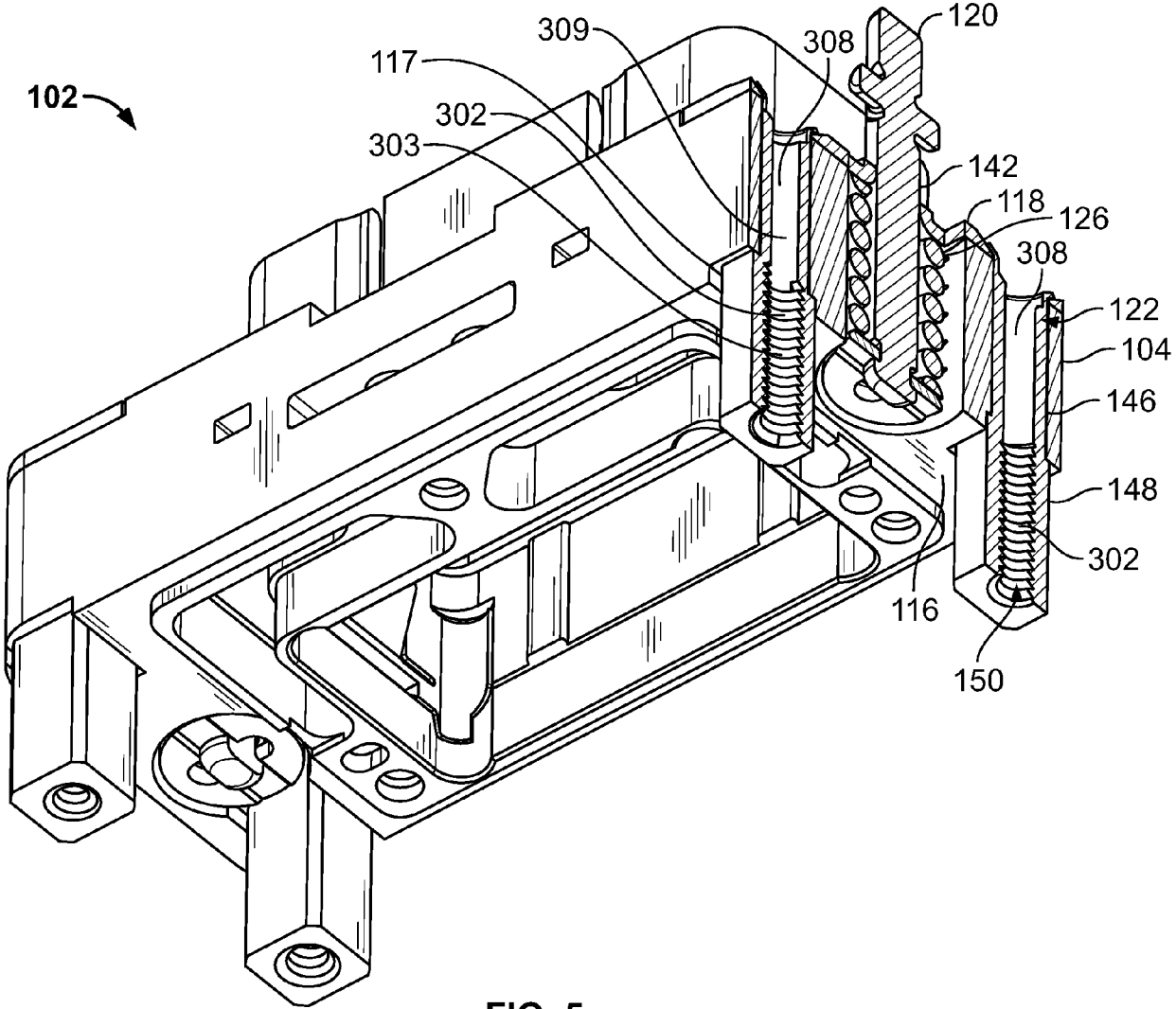
FIG. 5 illustrates a cross sectional view of the receptacle connector of FIG. 2 taken along line 5-5.

As shown in FIG. 5, the spacers 122 further include a through-hole 150 traversing from a top end 152 to a bottom end 154. The through-hole 150 includes spacer portion through-hole 302 and an insertion portion through-hole 308. In this exemplary embodiment, as shown in FIG. 5, the insertion portion through-hole 308 includes an non-threaded surface 311, and the spacer portion through-hole 302 includes internal threads 303. The spacers 122 may be used to attach the receptacle connector 102 at a predetermined distance from a substrate (not shown). In one embodiment, the substrate may be a printed circuit board (PCB). The spacers 122 may be used to attach the receptacle connector 102 to a substrate by receiving a fastener (not shown) in the spacer portion 148, where the fastener is further attached to the substrate. The fastener may be a screw or other similar threaded fastener.

Figure 5A:
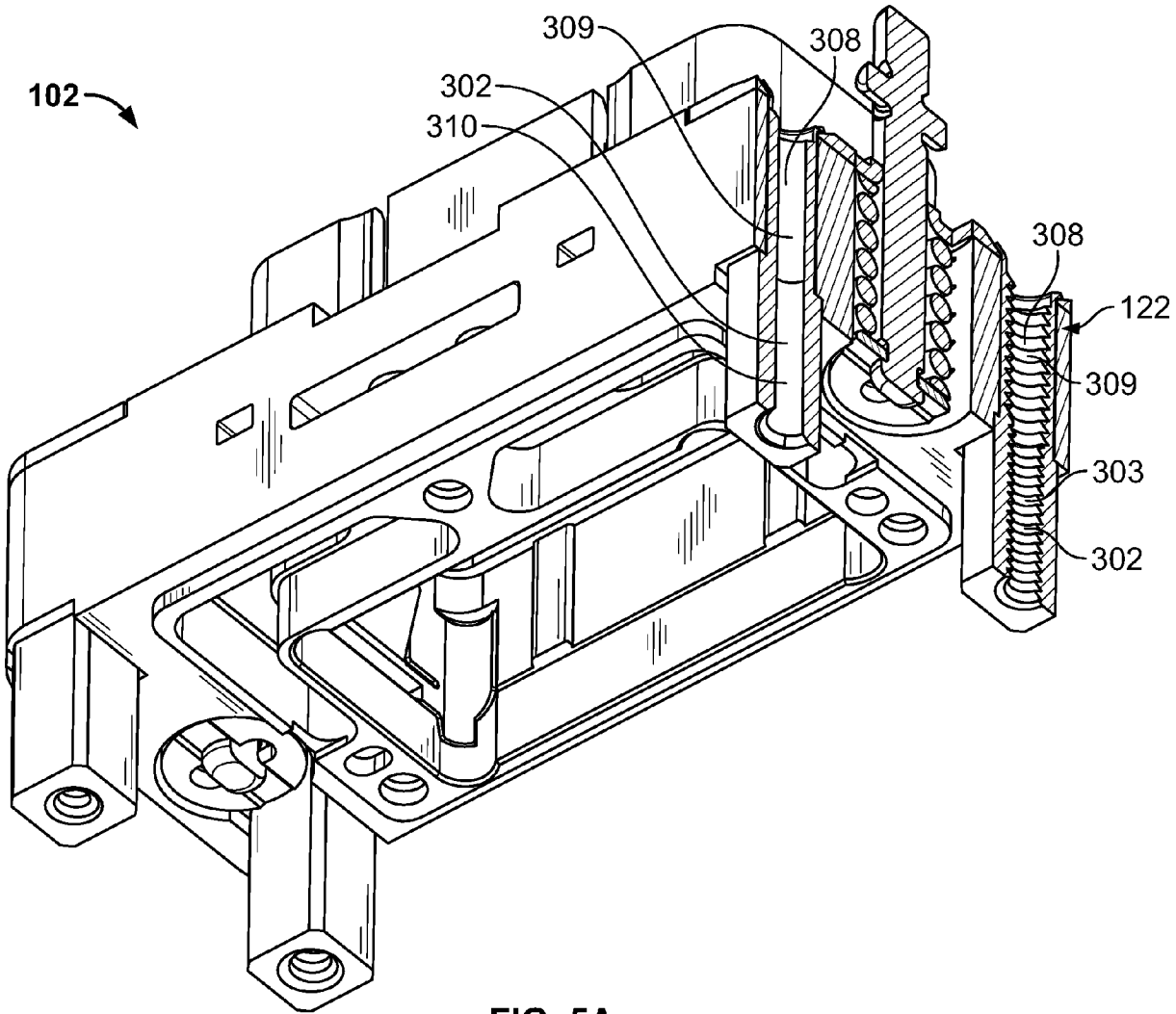

In another embodiment shown in FIG. 5A, a spacer 122 includes an insertion portion through-hole 308 including internal threads 309. In this embodiment, the internal threads 309 of the insertion portion through-hole 308 are different than the internal threads 303 of the spacer portion through-hole 302. The internal threads 309, 303 may differ by pitch, count, or other thread feature. In this embodiment, a screw (not shown) may be received in the insertion portion through-hole 146 to further securely assemble the spacers 122, support plate 118, and receptacle housing 104.

In yet another embodiment shown in FIG. 5A, a spacer 122 includes an insertion portion through-hole 308 including a non-threaded surface 309 and a spacer portion through-hole 302 including a non-threaded surface 310.

Referring again to FIGS. 2-5, the insertion portion 146 has a generally circular exterior cross-sectional geometry, and the spacer portion 148 has a generally square exterior cross-sectional geometry. In another embodiment, the insertion portion 146 and spacer portion 148 may have other cross-sectional geometry. For example, the insertion portion 146 and spacer portion 148 may have a generally circular or hexagonal exterior cross-section.

The spacers 122 are shown including a flare 156 at the top end 152. The flare 156 is formed on the top end 152 after the insertion portion 146 has been received in insert holes 134 to securely assemble the spacers 122 to the receptacle housing 104. The flare 156 may be formed by a flaring tool as would be appreciated by one of ordinary skill in the art. The spacer portion 148 of the spacers 122 is received in spacer recesses 117 in the bottom surface 116 of the receptacle housing 104 when the receptacle connector 102 is assembled.

The spring 126 is sized to be compressedly disposed in post hole 136 between the support plate 118 and the fastener 124 when the receptacle connector 102 is assembled as shown in FIG. 2. The compressibility of the spring 26 is selected to securely retain the post 120 against the support plate 118 and to securely assemble the receptacle connector 102 to the plug connector 101 (FIG. 1).

The fastener 124 includes a slot 158 configured to receive fastener feature 144 of post 120. The fastener 124 further includes a bottom surface 160 having a recess 162 configured to receive fastener feature 144 after the fastener feature has passed through the slot 158 and the fastener 124 has been rotated as shown in FIG. 1B. The fastener 124 compresses the spring 126 against the support plate 118 when assembled as shown in FIG. 3B.

Figure 6:
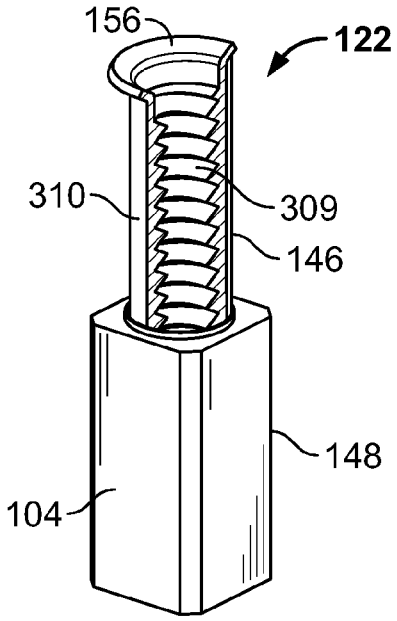
FIG. 6 illustrates a partial cross sectional perspective view of another embodiment of a spacer.
Figure 6A:
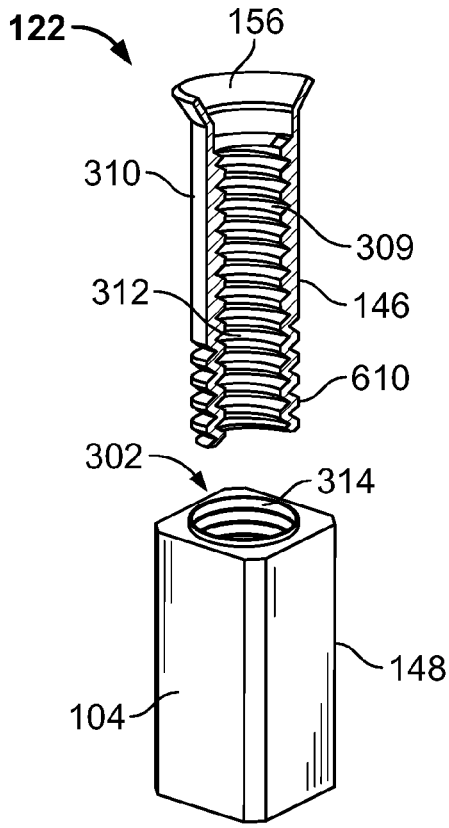
FIG. 6A illustrates an exploded view of the spacer of FIG. 6.

FIGS. 6 and 6A show another exemplary embodiment of spacers 122. In this embodiment, spacers 122 are formed from a separate insertion portion 146 and spacer portion 148. The insertion portion 146 includes internal threads 309 and external threads 610. External threads 610 are configured to engage internal threads 314 of the spacer portion. The insertion portion 146 includes flare 156. In this exemplary embodiment, the flare 156 may be formed prior to assembling the receptacle connector 102 (FIG. 2). In such a manner, the insertion portion 146 may be assembled with the spacer portion 148 having the flare 156 already formed so as to retain the support plate 118 (FIG. 2) when assembled. In another embodiment, the insertion portion 310 is received in insert holes 134 and then the flare 156 is formed.

In this exemplary embodiment, the insertion portion 146 is only received for a part of the length of the spacer portion 148. In other words, the external threads 610 do not extend the entire length of the internal threads 314.

In this exemplary embodiment, the insertion portion 146 has internal threads 309 for substantially the length of the insertion portion 146. In another embodiment, the insertion portion 146 may have internal threads for only a partial portion of the length of the insertion portion 146. In still another embodiment, the insertion portion 146 may have no internal threads 309. For example, the internal threads 309 may be included in the portion of the insertion portion 146 received in the spacer portion 148 or may have internal threads only in the portion of the insertion portion 146 not received in the spacer portion 148.

In another embodiment, not shown, the insertion portion 146 does not include external threads 610 and the spacer portion 148 does not include internal threads 314 in the portion of the spacer portion 148 receiving the insertion portion 146. The portion of the spacer portion 148 not receiving the insertion portion 146 may or may not be threaded. In this exemplary embodiment, the insertion portion 146 and the spacer portion 148 may be press-fit together to form the spacer 122.

Figure 6B:
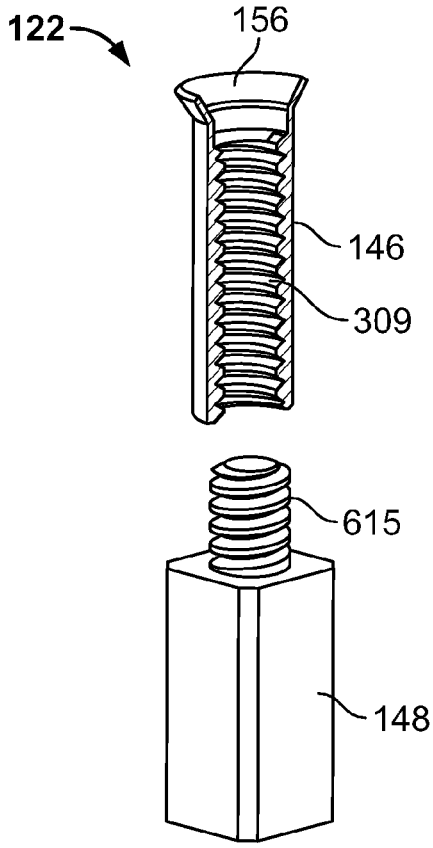
FIG. 6B illustrates a partial cross sectional perspective view of yet another embodiment of a spacer.
Figure 7:
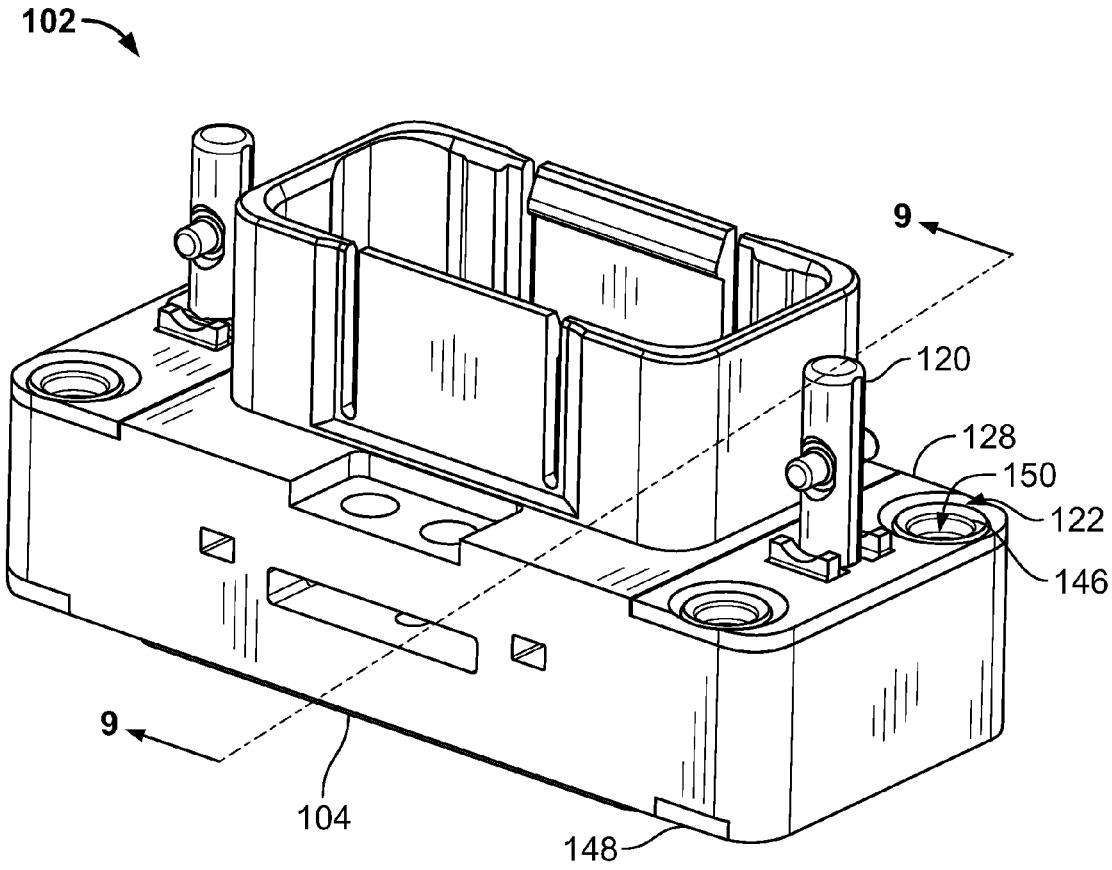
FIG. 7 illustrates another embodiment of a receptacle connector according to the disclosure.
Figure 8:
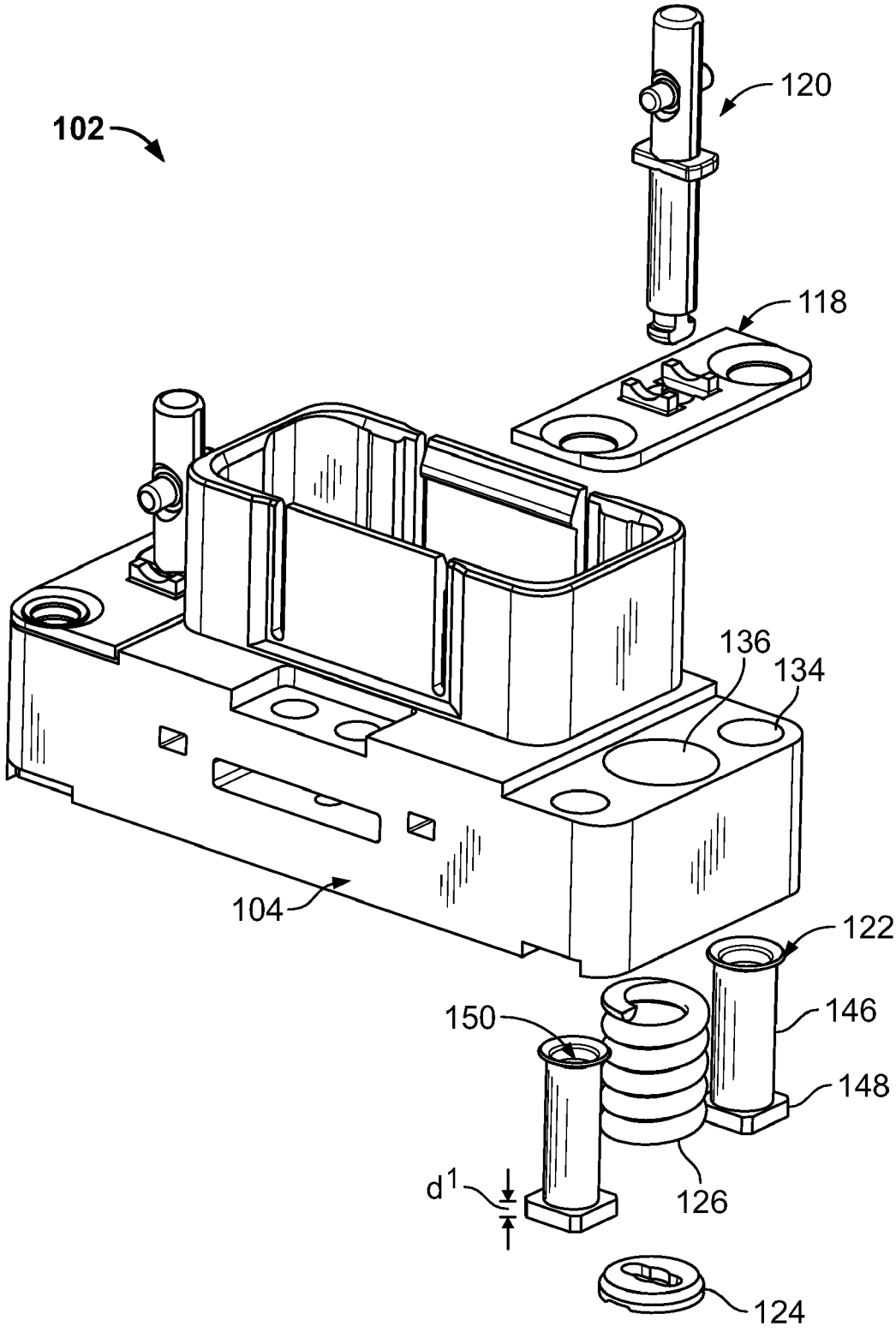
FIG. 8 illustrates an exploded view of the receptacle connector of FIG. 7.
Figure 9:
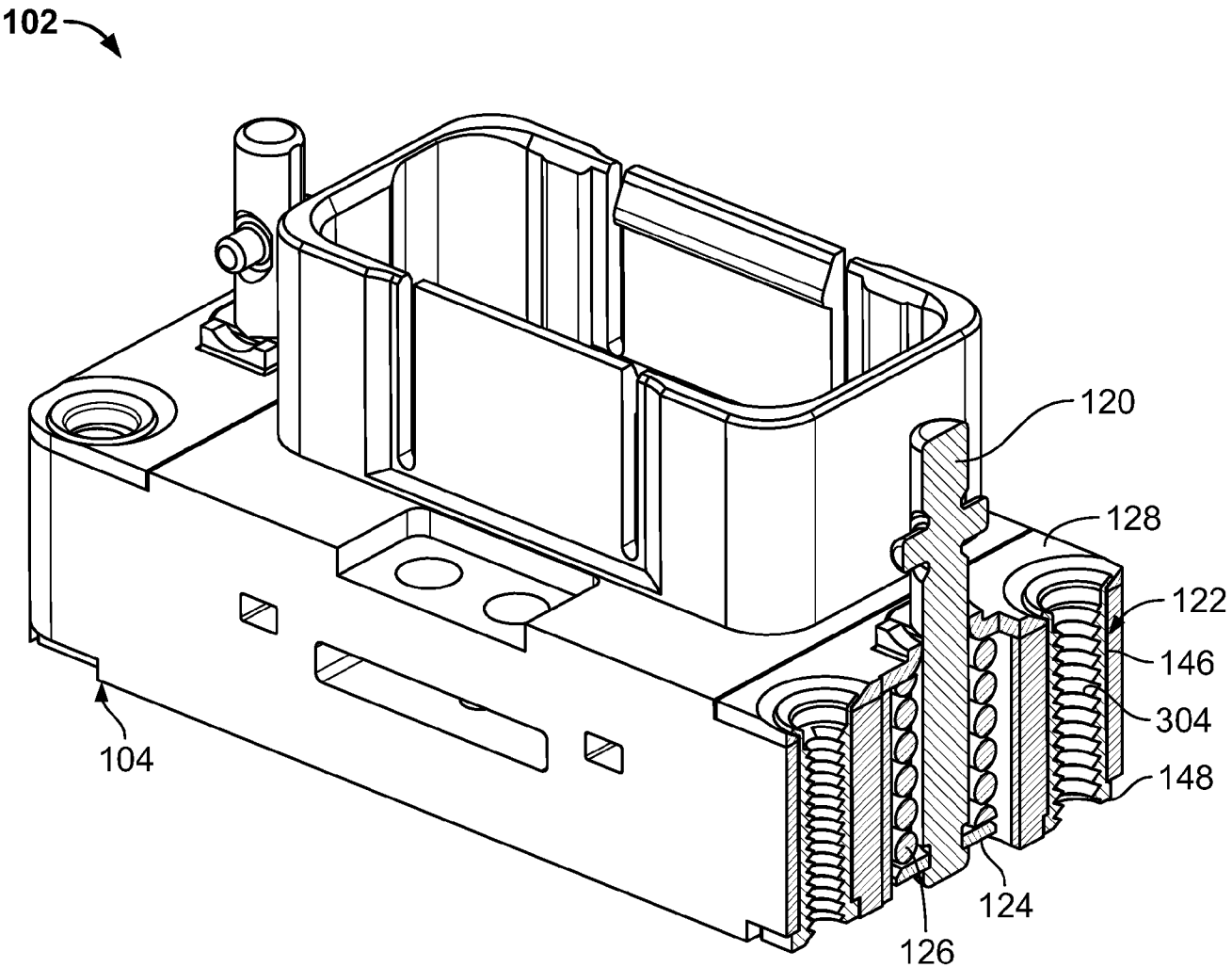
FIG. 9 illustrates a top cross sectional view of the receptacle connector of FIG. 7 taken along line 9-9.
Figure 10:
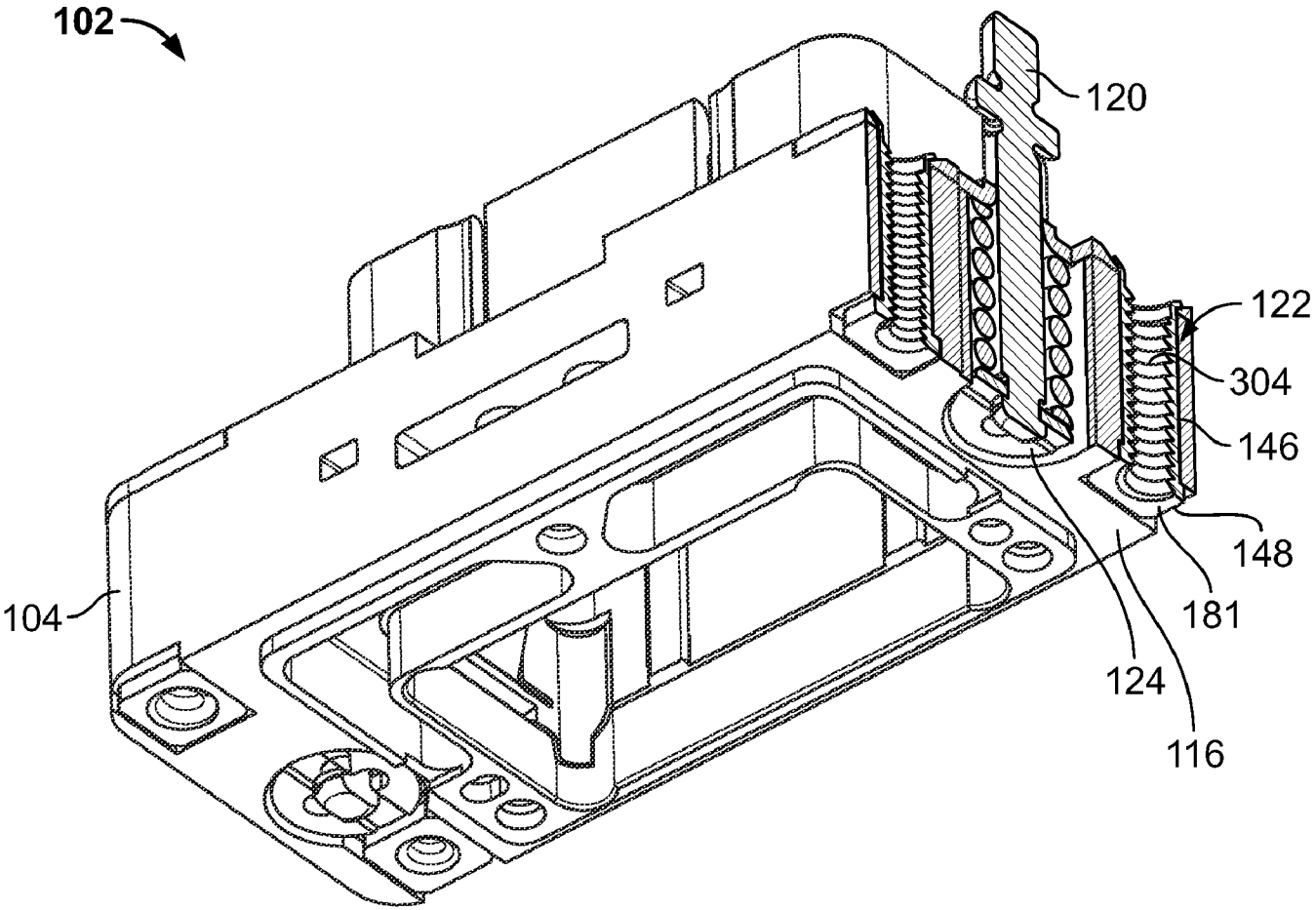
FIG. 10 illustrates a bottom cross sectional view of the receptacle connector of FIG. 7 taken along line 9-9.

FIG. 6B shows yet another exemplary embodiment of spacers 122. In this exemplary embodiment, the spacers 122 are formed from a separate insertion portion 146 and spacer portion 148, and the spacer portion 148 includes a threaded protrusion 615 configured to engage the internal threads 309 of the insertion portion 146. In this exemplary embodiment, the flare 156 may be formed before or after the insertion portion 146 is received in insert holes 132.

In the embodiments having the spacer 122 formed by a separate insertion portion 146 and spacer portion 148, the insertion portion 146 and the spacer portion 148 may be further secured joined by thermal welding, adhesive bonding or other joining methods.

FIGS. 7, 8, 9 and 10 show another exemplary embodiment of the receptacle connector 102. In this exemplary embodiment, the receptacle connector 102 includes yet another exemplary embodiment of spacers 122. In this exemplary embodiment, the spacers 122 include an insertion portion 146 and a spacer portion 148. The spacer portion 148 has a length d' to position a bottom 181 of the spacer portion 148 (see FIG. 10) approximately parallel with the bottom 116 of the receptacle housing 104. In this exemplary embodiment, the spacers 122 further include a through hole 150 that includes internal threads 304 covering substantially the length of the through hole 150. In another embodiment, the internal threads 304 may extend only a partial length of the through hole 150. In yet another embodiment, the internal threads 304 may be omitted.

Furthermore, in this exemplary embodiment, the spacers 122 are a unitary body. In another embodiment, the spacers 122 may include a separate insertion portion 146 and a spacer portion 148 that are joined as discussed above.

FIG. 11 shows two other exemplary alternative embodiments of spacers 122. In a first exemplary alternative embodiment, spacer 122*a* includes an insertion portion 146 that does not include a flare 156 after assembly. The spacer 122*a* includes a through hole 150 having internal threads 152. In this embodiment, the spacer 122*a* is assembled to the receptacle housing 104 and support plate 118 with a fastener 180 as shown. In this exemplary embodiment, the fastener 180 is a screw, however, other similar fasteners may be used. In another embodiment, the fastener 180 may include a post or a through-hole, which may be threaded.

In this exemplary embodiment, the insertion portion 146 and spacer portion 148 are a single component, however, in other embodiments as discussed above, the insertion portion 146 and spacer portion 148 may be separate components. Furthermore, in this exemplary embodiment, the spacer portion 148 has a bottom surface 181 (FIG. 10) that is substantially parallel with the bottom surface 116 (FIG. 10) of the housing 104. In another embodiment, the spacer 122*a* may include a spacer portion 148 that extends away from the bottom surface 181 of the housing 104 as discussed above.

FIG. 11 also shows another exemplary alternative embodiment of a spacer 122*b*. In this embodiment, the spacer 122*b* includes an insertion portion 148 having internal threads 309 and a spacer portion 149 having external threads 149*a* configured to engage the internal threads 152 of the insertion portion 146. As can be seen in FIG. 11, the spacer portion 148 does not include a through hole, but is a solid body. In this exemplary embodiment, the insertion portion 146 includes a flare 156 which may be formed prior to or during assembly of the connector 102. In another embodiment, the spacer 122*b* may include a spacer portion 149 that extends away from the bottom surface 181 of the housing 104 as discussed above.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. An electrical connector assembly, comprising:

a plug connector, and a receptacle connector comprising a receptacle housing having a top surface and a bottom surface, a support plate, a spacer configured to retain the support plate adjacent to the top surface, and a post retained against the support plate by a spring and a fastener configured to releasably assemble the post and the support plate to the receptacle housing;

wherein the receptacle connector is configured to mate with the plug connector by releasably engaging the post and the plug connector.

2. The assembly in claim 1, wherein the spacer comprises an insertion portion disposed within the receptacle housing and a spacer portion.

3. The assembly of claim 2, wherein the spacer portion extends a predetermined distance from the bottom surface of the receptacle housing.

4. The assembly in claim 2, wherein the spacer portion is flush with the bottom surface of the receptacle housing.

5. The assembly of claim 2, wherein the insertion portion and spacer portion are a unitary body.

6. The assembly of claim 2, wherein the insertion portion and the spacer portion are separate components.

7. The assembly of claim 2, wherein in spacer portion is a solid body.

8. The assembly of claim 1, wherein the spacer includes a through hole extending through the insertion portion and the spacer portion.

9. The assembly of claim 5, wherein the through hole is at least partially threaded.

10. The assembly of claim 1, wherein the spacer includes a flare configured to retain the support plate against the top surface.

11. The assembly of claim 1, wherein the spacer is assembled to the support plate and receptacle housing by a fastener.

12. A receptacle connector comprising:

a receptacle housing having a top surface, a bottom surface and a post hole extending between the top surface and the bottom surface;

a support plate adjacent the top surface, a spacer configured to securely retain the support plate adjacent to the top surface; and a post extending through the post hole and retained against the support plate by a spring and a spring fastener configured to releasably assemble the post and the support plate to the receptacle housing;

wherein the receptacle connector is configured to mate with the plug connector by releasably engaging the post and the plug connector.

13. The connector of claim 12, wherein the spacer comprises an insertion portion disposed within the receptacle housing and a spacer portion.

14. The connector of claim 13, wherein the spacer portion extends a predetermined distance from the bottom surface of the receptacle housing.

15. The connector of claim 12, wherein the spring and spring fastener are disposed within the post hole.

16. The assembly in claim 13, wherein the spacer portion has a bottom surface substantially parallel with the bottom surface of the receptacle housing.

17. The assembly of claim 13, wherein the insertion portion and spacer portion are a unitary body.

18. The assembly of claim 13, wherein the insertion portion and the spacer portion are separate components.

19. The connector of claim 13, wherein in spacer portion is a solid body.

20. The assembly of claim 12, wherein the spacer includes a through hole extending through the insertion portion and the spacer portion.

21. The assembly of claim 20, wherein the through hole is at least partially threaded.

22. The assembly of claim 12, wherein the spacer includes a flare configured to retain the support plate against the top surface.

23. The assembly of claim 12, wherein the spacer is assembled to the support plate and receptacle housing by a fastener.

* * * * *